US006100858A

United States Patent [19]

Tran

[11] Patent Number: 6,100,858

[45] Date of Patent: Aug. 8, 2000

[54] ALPHANUMERIC DISPLAY WITH 21-DOT MATRIX FORMAT

[75] Inventor: Van N. Tran, Fremont, Calif.

[73] Assignee: Infineon Technologies North America Corp., San Jose, Calif.

[21] Appl. No.: 08/940,703

[22] Filed: Sep. 30, 1997

[51] Int. Cl.[7] ..... G09G 3/06

[52] U.S. Cl. ..... 345/59; 345/33

[58] Field of Search ..... 345/33, 44, 46, 345/34, 103, 59; 382/176; 349/142; 313/513, 517

[56] References Cited

U.S. PATENT DOCUMENTS

| | | | |
|---|---|---|---|
| H681 | 9/1989 | Weideman | 382/176 |
| 3,015,094 | 12/1961 | Reynolds, Jr. | 345/44 |
| 3,872,463 | 3/1975 | Lapeyre | 345/46 |
| 4,109,245 | 8/1978 | Hedin | 345/44 |
| 4,237,459 | 12/1980 | Cordova | 340/756 |
| 4,482,894 | 11/1984 | Matsui et al. | 345/33 |
| 5,016,002 | 5/1991 | Levanto | 340/756 |
| 5,475,516 | 12/1995 | Yoshizawa et al. | 359/54 |

*Primary Examiner*—Jeffery Brier

[57] ABSTRACT

An alphanumeric symbol generator having a five-by-five matrix of twenty-one pixels. The pixels are arranged such that there are no pixels at the points where the second and fourth columns intersect with the second and fourth rows. The pixels may be light emitting devices, such as light emitting diodes or liquid crystal displays. The pixels may also consist of the pins in a dot-matrix printer. The pixels in the five-by-five matrix are activated in response to electronic codes corresponding to alphanumeric characters. Typically, a series of 21-pixel matrices are aligned side-by-side to create a display that communicates multiple words, numbers, and symbols.

18 Claims, 6 Drawing Sheets

ALPHANUMERIC DISPLAY WITH 21-DOT MATRIX FORMAT

BACKGROUND OF THE INVENTION

The present invention relates to an electronic display, such as a light emitting diode (LED) display, and more particularly to a display that has a matrix of pixel units for expressing alphanumeric symbols.

DESCRIPTION OF THE RELATED ART

An increasing number of electronic devices, such as telephones, radios, calculators, appliances, and watches, require the use of an alphanumeric display as an information transfer channel between the user and the device. Various types of alphanumeric displays are commercially available. As shown in FIG. 1, numeric characters are commonly displayed using a seven-segment display 10. Alternatively, as shown in FIG. 2, numeric characters and alphabetic characters are commonly displayed using a fourteen-segment display 14. These displays work by illuminating portions of the display segments in order to form the desired character.

Alphanumeric displays are also available in a dot matrix format. In a dot matrix display, characters are presented on a matrix comprising pixels, or segments, arranged in rows and columns. In a five-by-five, 25-dot matrix 18, shown in FIG. 3, pixels are illuminated to form numerals, letters, and various symbols, such as plus signs "+", and question marks "?".

Another popular dot matrix format is shown in FIG. 4 as a matrix of five columns of pixels by seven rows of pixels. The resulting 35-dot matrix 22 can display numbers, letters, and various characters with increased detail.

In addition to the display formats described above, other display formats are disclosed in the following U.S. Pat. No. 4,237,459 to Cordova, No. 5,016,002 to Levanto, and No. 5,475,516 to Yoshizawa et al. The patent to Cordova discloses alphanumeric displays having light-generating elements in a five-by-eleven matrix and a five-by-twelve matrix. The elements in the matrices are divided among upper, central, and lower sections. The elements are arranged such that the display can be utilized to image lowercase alphabet characters of differing heights with good resolution.

The display disclosed in Cordova has a large number of illumination elements in the central section to allow the body of the character immediately above a designated baseline to be imaged with a high degree of resolution. In the upper and lower sections, illumination elements are provided only in those areas necessary to display ascenders and descenders of lowercase letters.

The patent to Levanto discloses an alphanumeric display having a three-by-five matrix in which one of the matrix "elements" has been divided into two elements so that the matrix actually has sixteen elements. In Levanto, the matrix elements have different shapes and an asymmetrical orientation for displaying alphanumeric characters.

The patent to Yoshizawa et al. discloses an alphanumeric display having basically a three-by-five matrix in which two matrix elements have been bisected so that the matrix actually has seventeen elements. Yoshizawa et al. uses the bisected matrix elements to form certain characters and to enhance resolution.

All of the above-listed approaches work well for their intended purpose. However, each light emitting element that is placed into a display device adds cost to the device. In five-by-five and five-by-seven dot matrix arrangements, either twenty-five or thirty-five light emitting elements must be placed into the devices.

What is needed is a dot matrix display that minimizes the number of light emitting elements necessary to create numbers, letters, and symbols, while still providing a fully functional display.

SUMMARY OF THE INVENTION

The invention is an alphanumeric symbol generator. The symbol generator has at least one matrix of twenty-one functionally associated pixels, wherein each matrix has five columns and five rows. Each matrix has twenty-five positions for the twenty-one pixels. Each matrix has a top row containing five equidistantly spaced pixels, with one pixel in each of a first, second, third, fourth, and fifth column of the matrix. Within a second row directly below the top row and within a fourth row, the matrix contains three pixels and two void positions. There is a pixel in each of the first, third, and fifth columns, so that the second and fourth rows each have an absence of pixels in the second and fourth columns. In each of a third row and a bottom row, there are five equidistantly spaced pixels, one pixel in each of the first, second, third, fourth, and fifth columns. In operation, the twenty-one pixels of the matrix are selectively activated to form alphanumeric characters in response to predetermined signals.

In the preferred embodiment of the invention, the pixels are light emitting devices such as light emitting diodes or liquid crystal displays. A series of the preferred matrices can be arranged side-by-side to produce a multi-character display device. For example, ten matrices can be arranged in a row to form a 10-digit display.

A typical display system has a control system that includes memory and a processor. The memory stores the codes necessary to activate the appropriate pixels to create alphanumeric characters. The processor responds to specified signals and then operates to activate or deactivate the proper pixels.

In an alternative embodiment of the invention, the pixels are pins in a dot-matrix printer head. The pins are directed to impact printing ribbon against paper in order to print alphanumeric characters.

DETAILED DESCRIPTION

Figure 1:
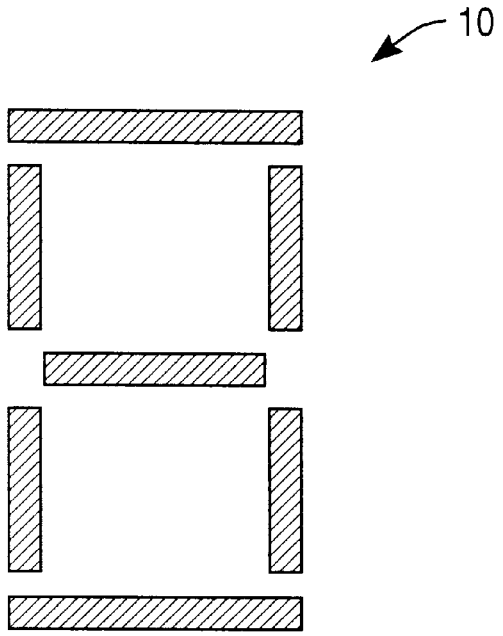
FIG. 1 (PRIOR ART)
FIG. 1 is a depiction of a seven-segment display arrangement that is known in the prior art.
Figure 2:
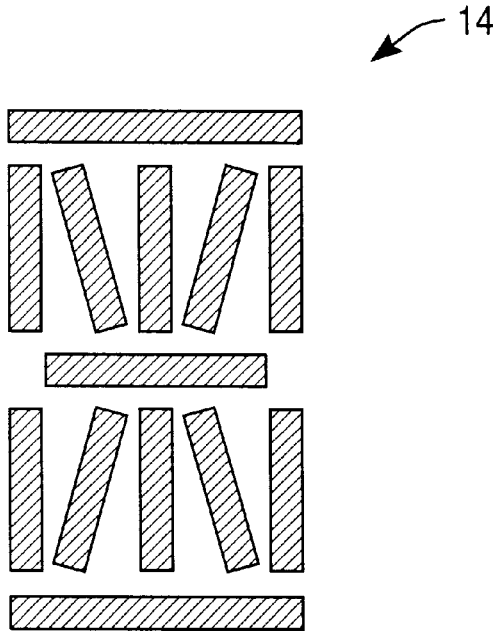
FIG. 2 (PRIOR ART)
FIG. 2 is a depiction of a fourteen-segment display arrangement that is known in the prior art.
Figure 3:
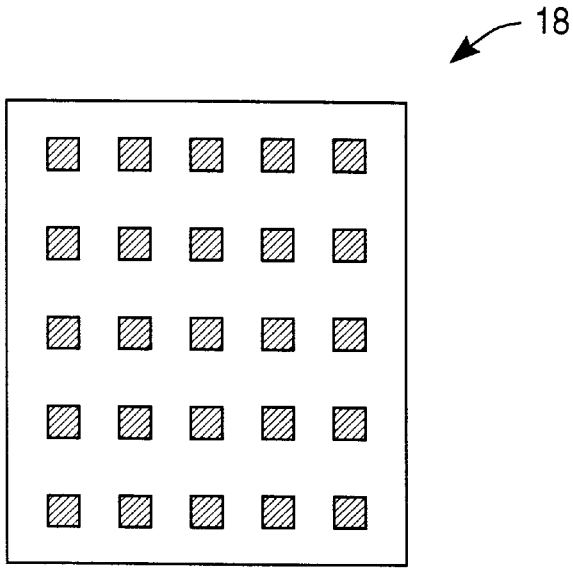
FIG. 3 (PRIOR ART)
FIG. 3 is a depiction of a 25-dot display matrix that is known in the prior art.
Figure 4:
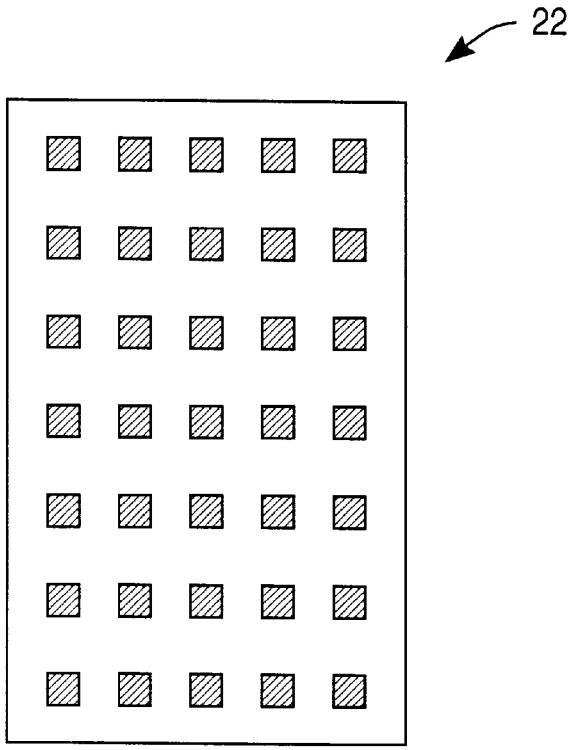
FIG. 4 (PRIOR ART)
FIG. 4 is a depiction of a 35-dot display matrix that is known in the prior art.
Figure 5:
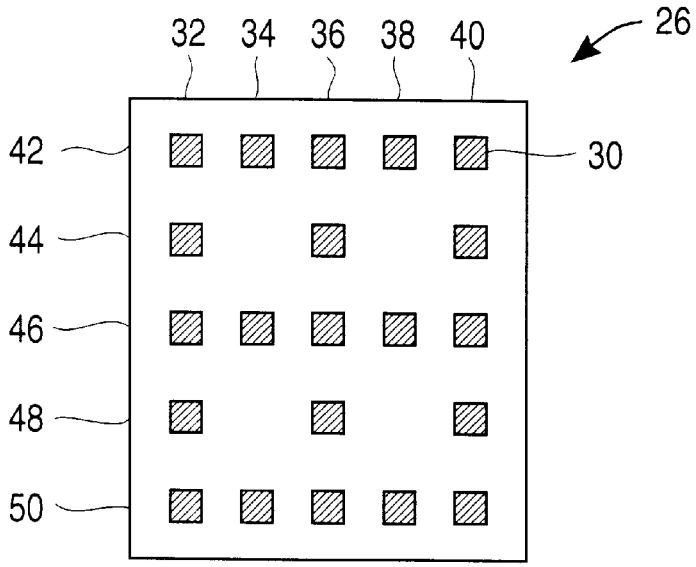
FIG. 5 is a depiction of a 21-dot display matrix in conformance with the current invention.

FIG. 5 is a depiction of the preferred embodiment of a 21-dot matrix 26. The individual illuminable elements 30 are arranged in a rectilinear matrix in vertical columns and horizontal rows. The convention used by persons in the art is to refer to the number of columns first and the number of rows second. For example, a matrix with five columns and seven rows is referred to as a five-by-seven matrix. In referring to the columns, the leftmost column is the first column. The next column to the right of the first column is the second column, and so on. In referring to the rows, the uppermost row is the first row. The next row below the first row is referred to as the second row, and so on.

The elements 30 depicted in FIG. 5 are sometimes identified as dots and as pixels. For purposes of this description, the elements will be primarily referred to as pixels. A "pixel" in this embodiment is any defined area that has the capability of being activated or deactivated in some way, so that the pixel area is visually distinguishable from other surrounding areas. The pixels will most commonly consist of light emitting devices, such as light emitting diodes (LEDs) or liquid crystal display (LCD) segments. However, the pixels may also consist of the pins in a dot matrix printer or any other appropriate distinguishing mechanism.

Using the convention identified above, the preferred embodiment is illustrated in FIG. 5 as a five-by-five matrix of only twenty-one pixels. The matrix is comprised of columns one through five 32, 34, 36, 38, 40 and rows one through five 42, 44, 46, 48, 50. In a typical five-by-five matrix, there are positions for twenty-five pixels. However, as can be seen, in the second row 44 and the fourth row 48 there are no pixels in the second column 34 and the fourth column 38. The result is a symmetrical pixel spacing within a twenty-one pixel matrix that appears to have four empty or void positions.

The four void positions are chosen based on a statistical analysis of the frequency of use of the particular positions in a conventional 25-dot matrix. That is, the positions that are used least frequently in the formation of alphanumeric characters do not have pixels in the embodiment of FIG. 5. As a result, the conventional five-by-five matrix having twenty-five pixels has been modified to have only twenty-one pixels. The 21-pixel matrix format can be used to create all of the uppercase and lowercase letters of the alphabet, the numbers zero through nine, and various other symbols.

The statistical approach may also be applied to a five-by-seven matrix having thirty-five positions. In the five-by-seven matrix, some of the least frequently used positions are eliminated and the matrix is still able to create all of the uppercase and lowercase letters of the alphabet, the numbers zero through nine, and various other symbols.

Figure 6:
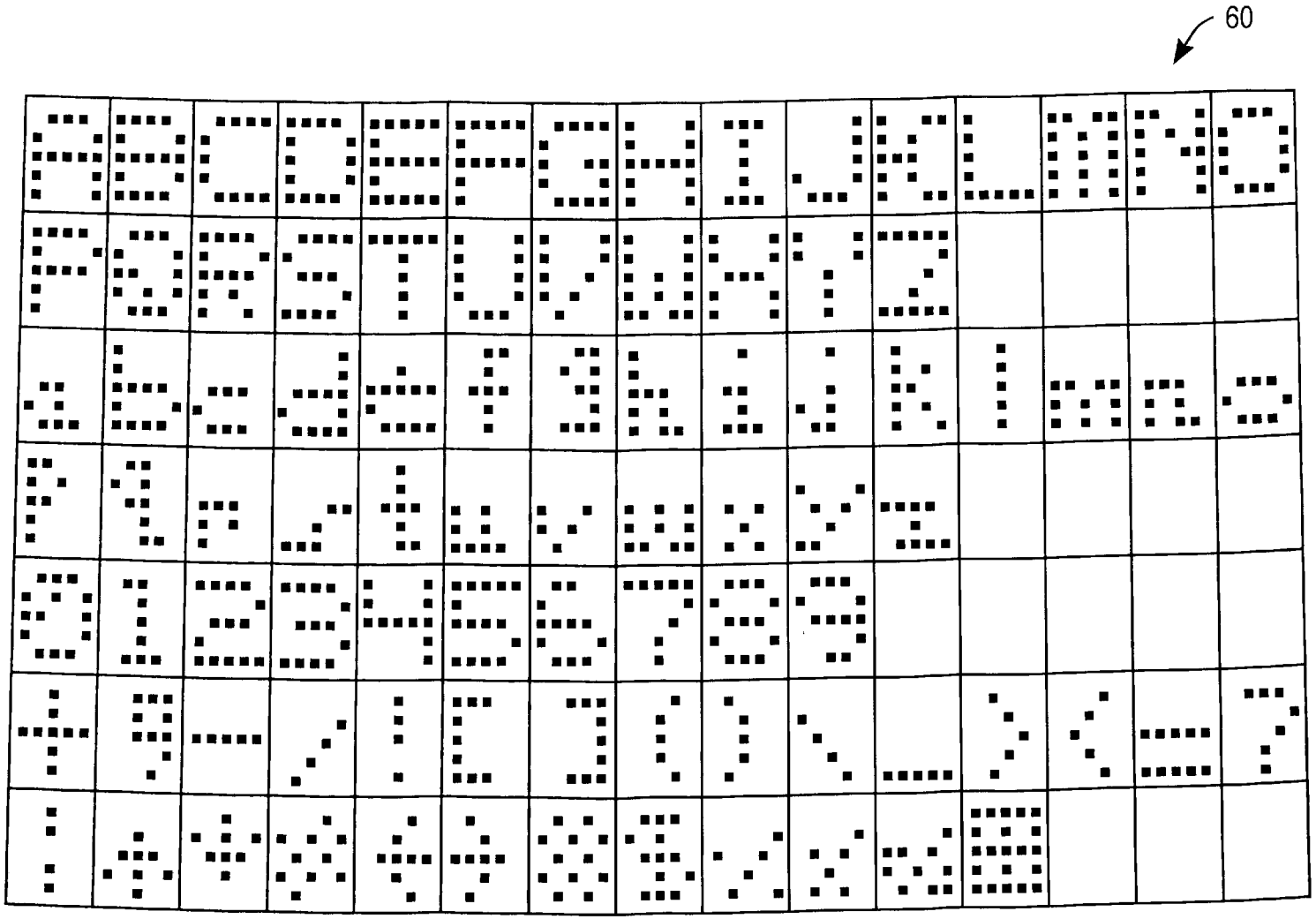
FIG. 6 is a depiction of the character set created using a 21-dot display matrix in conformance with the current invention.

FIG. 6 is a depiction of the preferred alphanumeric character set 60 formed using twenty-one pixels in a five-by-five matrix. The character set is for example purposes, and there are certainly alternative approaches to forming alphanumeric characters that are not shown in the example.

Figure 7:
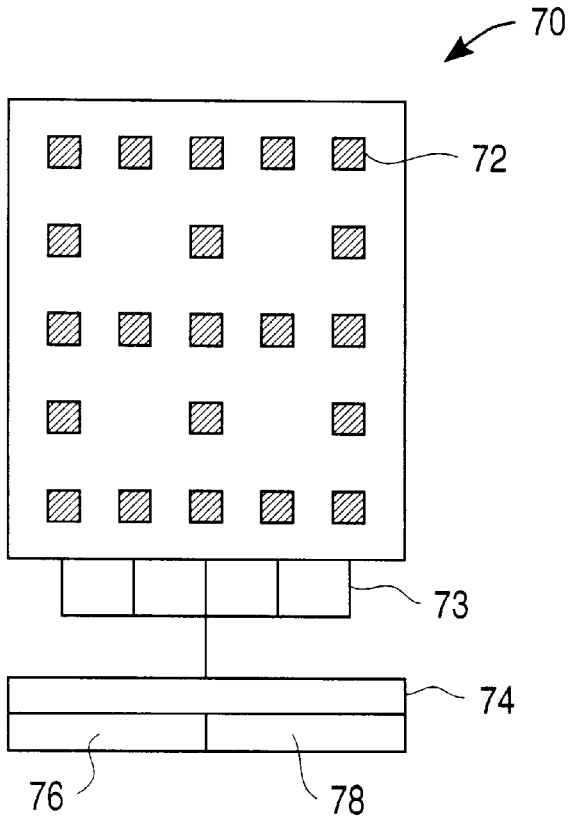
FIG. 7 is a depiction of a 21-pixel display system in conformance with the current invention.

FIG. 7 is a depiction of the preferred embodiment of a 21-pixel display system 70. Each individual pixel 72 in the display system is a discrete LED. The LEDs are connected by data channels 73 to a control system 74 that controls the activation of the pixels. The pixels in the preferred embodiment have an active state and an inactive state. In the active state, a pixel receives an excitation signal and emits light. In the inactive state, the pixel is not receiving an excitation signal and consequently does not emit light.

The control system that selectively activates the LEDs is typically an integrated circuit. The integrated circuit contains memory 76 and a processor 78. The memory in the control system stores the codes for forming the different alphanumeric characters that are available. The processor responds to specified signals and then operates to activate or de-activate the proper pixels. The data channels may be any conventional data channels, such as conducting lines in an integrated circuit or in a printed circuit board.

Specified signals that are input to the processor 78 can be the result of user interaction with a device. For example, the user of a telephone may direct a series of menu prompts to be displayed on the telephone's display screen. The processor receives the signals triggered by the user to display certain words, and then the codes for forming the letters of the words are accessed from the memory 76 of the display device. The control system 74 then activates the appropriate pixels to form the words on the telephone's display.

Another example of a source of specified signals is a pager. If a pager receives a message that includes the telephone number of an outside caller, the control system of the pager display accesses the appropriate code information from the memory and then illuminates the corresponding pixels of each matrix in a series of matrices to create the desired telephone number.

As described, a 21-pixel matrix is able to create a single character per matrix. In order to communicate information, such as the menu prompts or telephone numbers as described above, using a 21-pixel matrix, multiple matrices can be placed side-by-side. When multiple matrices are placed side-by-side, words and phrases can be displayed so that more information can be expressed.

Figure 8:
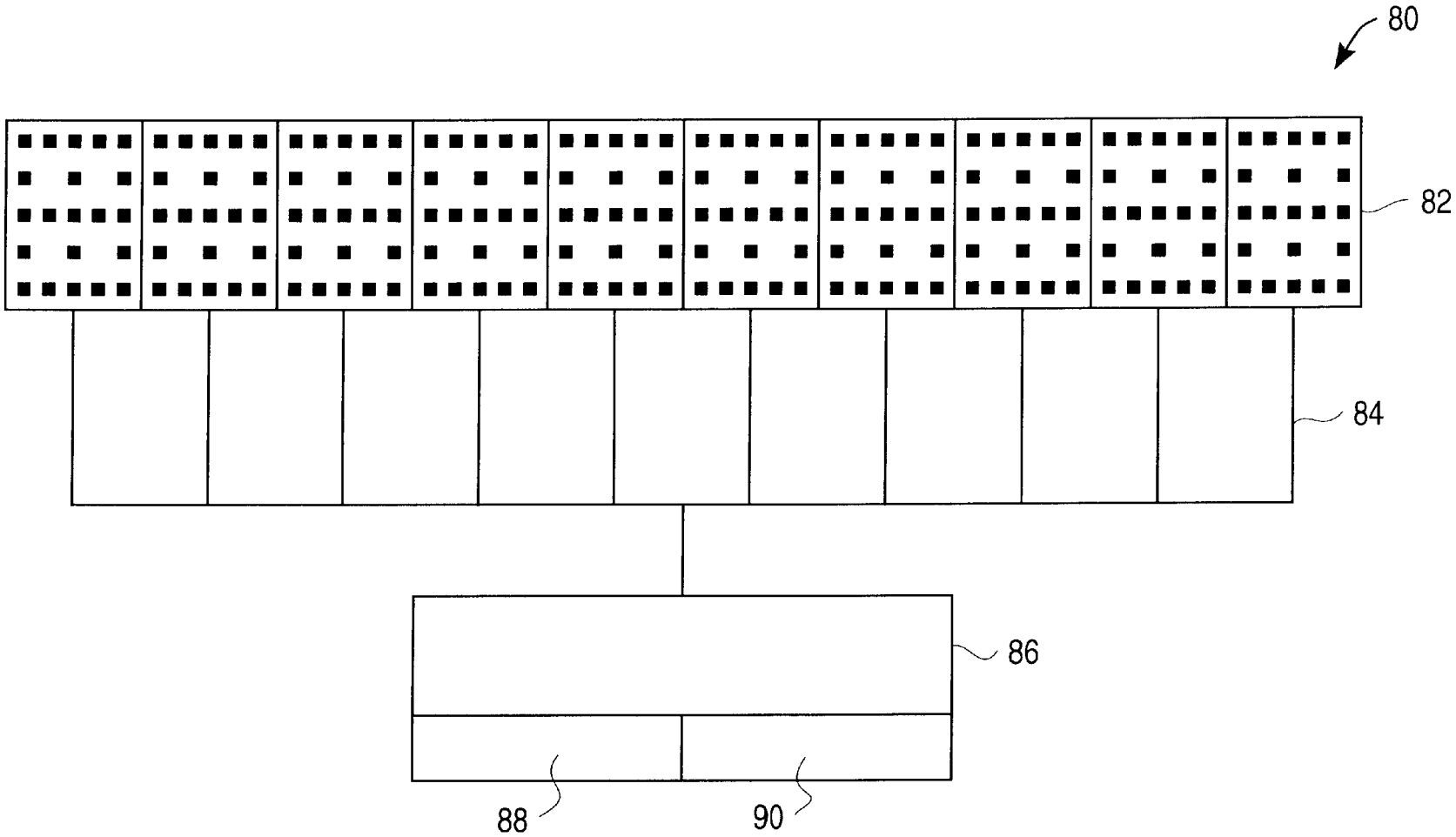
FIG. 8 is a depiction of a one-time 10-digit display system in conformance with the current invention.

The preferred embodiment of the invention has been used to create a one-line 10-digit display system. Referring to FIG. 8, the 10-digit display 80 is made up of ten individual 21-pixel matrices 82 placed side-by-side. The 10-digit display is supported by data channels 84 and a control system 86. The control system consists of memory 88 and a processor 90.

For example purposes, the preferred embodiment of the invention is described with reference to a complete display device. The display device of FIG. 5 may measure approximately 41.5 millimeters in width by 18.5 millimeters in height by 4.5 millimeters in thickness. The display is controlled by a specially designed integrated circuit. The integrated circuit controller has no internal clock, no pre-scaler, no current trimming, and the electrical current ($I_{LL}$) per LED is 0.4 mA ±20% at 25° C.

The interface of the 10-digit display has eight pins. The pins transfer data concerning load, the serial clock, common drive voltage of the logic ($V_{cc}$) drive voltage for the LEDs ($V_{LL}$), $V_{ss}$ (ground), serial input, and the multiplex clock.

The package of the 10-digit display includes the integrated circuits, the LEDs, and the pins mounted onto a printed circuit board (PCB). The PCB is housed in a clear plastic with no pad printing. A reflector is built into the housing to prevent cross-talk between the annunciators.

In operation, the drive voltage of the logic ($V_{cc}$) ranges from approximately 2.7–3.0 V. The drive voltage for the LEDs ($V_{LL}$) ranges from approximately 3.0–3.3 V. The typical current with twelve pixels per matrix, in each of the ten matrices activated, is approximately 50 mA at 25° C.

Figure 9:
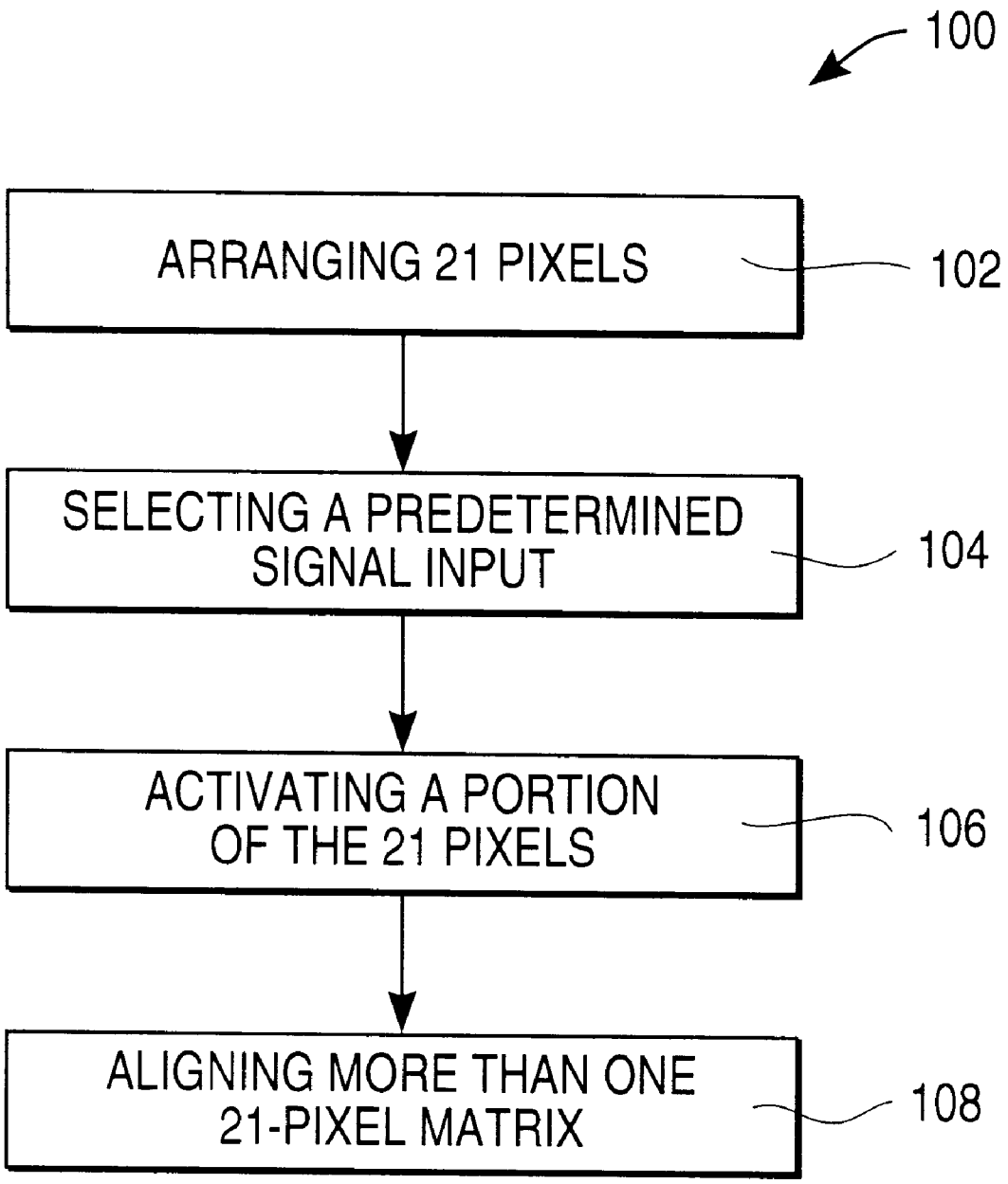
FIG. 9 is a depiction of a method for displaying an alphanumeric character in conformance with the current invention.

Referring to FIG. 9, a method 100 is disclosed for displaying an alphanumeric character in conformance with the present invention. The first step in the method involves arranging 102 twenty-one pixels into a five-by-five matrix. The pixels in the matrix are arranged in the order as depicted in FIG. 5. The next step involves selecting 104 a predetermined signal to be input into the matrix. The following step involves activating 106 a portion of the pixels so that the activated pixels are distinguished from the non-activated pixels. The activated pixels are arranged according to the predetermined signal that was previously selected in order to form the desired alphanumeric character.

The method described above is able to form a single digit, such as one letter or one number. In an alternative embodiment of the invention, a series of the 21-pixel matrices can be arranged 108 in a side-by-side fashion so that more information, such as words and/or phrases, can be displayed.

In an alternative embodiment of a 21-pixel matrix, each individual pixel is a pin used in a dot matrix printer. A dot matrix printer works by having pins impact a printer ribbon against a piece of paper. Ink dots are printed on the paper at each impact point of the pins on the ribbon. The pins impact the ribbon and paper in a rapid-fire manner as the printer head moves horizontally across the paper. The dot patterns transferred to the paper create the desired alphanumeric characters.

The pins used in a dot matrix printer are vertical columns. In the preferred embodiment, a printer head consists of at least one 21-pin matrix of vertical columns arranged as depicted in FIG. 5. During the printing process, each pin acts as an independent hammer. When a particular pin is activated, the pin is thrust forward so that the pin impacts the printing ribbon against the desired paper. In this respect, the activated pin distinguishes itself from the non-activated pins in the matrix. In order to form alphanumeric characters, multiple pins are activated simultaneously to print the individual characters. The process is repeated to form words and sentences, as is well known in the art.

What is claimed is:

1. An alphanumeric symbol generator comprising:

at least one matrix of twenty-one functionally associated pixels, wherein each matrix has five columns and five rows, thereby defining twenty-five positions for said twenty-one pixels, said matrix consisting of:

a top row containing five pixels, one pixel in each of first, second, third, fourth, and fifth columns of said matrix, a second row, directly below said top row, containing three pixels and two void positions, one pixel in each of said first, third, and fifth columns, said second row thereby having an absence of pixels in said second and fourth columns, a third row, directly below said second row, containing five pixels, one pixel in each of said first, second, third, fourth, and fifth columns, a fourth row, directly below said third row, containing three pixels and two void positions, one pixel in each of said first, third, and fifth columns, said fourth row thereby having an absence of pixels in said second and fourth columns, a bottom row, directly below said fourth row, containing five pixels, one pixel in each of said first, second, third, fourth, and fifth positions, wherein said pixels are individually addressable for selective activation of particular ones of said pixels to form alpha-numeric characters in response to predetermined signals.

2. The symbol generator of claim 1 wherein each pixel is a light emitting device and said twenty-five positions in said matrix are equidistantly spaced.

3. The symbol generator of claim 1 wherein said matrix is a single-digit matrix in a series of single-digit matrices, said single-digit matrices being aligned in a side-by-side relationship in a row to create an alphanumeric display device in which each single-digit matrix forms a single alphanumeric character at any one time, each single-digit matrix consisting of twenty-one functionally associated pixels.

4. The symbol generator of claim 1 further comprising an input device that contains one of a memory and a data processor for storing said predetermined signals, said input device having a unique connection to each of said pixels in said matrix.

5. The symbol generator of claim 4 wherein said memory contains code information as to which pixels must be activated to form a particular alphanumeric character.

6. The symbol generator of claim 3 wherein said series of single-digit matrices of pixels is a series of at least ten single-digit matrices arranged side-by-side in a row.

7. The symbol generator of claim 1 wherein each pixel is part of a character-generating device in a dot matrix printer.

8. A method for displaying alphanumeric characters including the steps of:

arranging twenty-one pixels in a matrix defined by five columns and five rows, said five columns including a first column, a second column, a third column, a fourth column, and a fifth column, said five rows including a first row, a second row, a third row, a fourth row, and a fifth row, said step of arranging including leaving an absence of pixels at each intersection of an even-numbered column with an even-numbered row and locating one pixel at each remaining intersection of said rows and said columns;

forming connections to said matrix such that said twenty-one pixels can be separately activated;

selecting any one of a plurality of predetermined signal inputs to said matrix; and activating a plurality of said twenty-one pixels in response to said selected signal input, wherein said activated pixels are distinguished from non-activated pixels, thereby displaying an alphanumeric character that is created from an arrangement of said activated pixels.

9. The method of claim 8 wherein said step of arranging twenty-one pixels is a step of arranging one of twenty-one light emitting devices or twenty-one liquid crystal segments.

10. The method of claim 8 further including a step of aligning more than one of said twenty-one pixel matrices in a row to display a plurality of alphanumeric characters.

11. The method of claim 8 wherein said step of selecting a signal input is a step of providing one of a data memory and a data processor that enables said signal input to be received by said matrix, said data memory having stored information relating to forming a plurality of alphanumeric characters.

12. The method of claim 8 wherein said step of displaying an alphanumeric character is a step of displaying any one of a letter from the English alphabet or a numeral from 0 to 9.

13. The method of claim 8 wherein said step of displaying an alphanumeric character is a step of transferring a representation of an alphanumeric character on to another medium.

14. The method of claim 13 wherein sad step of transferring an alphanumeric character onto another medium is a step of printing a representation of an alphanumeric character onto paper and wherein said step of arranging twenty-one pixels is a step of arranging twenty-one pins in a dot-matrix printer.

15. An electronic display consisting of:

twenty-one pixels in a matrix of five columns and five rows in which said pixels are equidistantly spaced to form a first and second pattern, said first pattern consisting of a completed square at the periphery of said matrix such that adjacent pixels are equidistantly spaced within said first pattern, and said second pattern consisting of a plus sign within an interior of said completed square such that a center row and a center column are each formed of five equidistantly spaced pixels; and a control system, said control system being individually connected to said twenty-one pixels via data channels, said data channels enabling said control system to individually activate and deactivate said twenty-one pixels in order to create any one of a plurality of symbols.

16. The electronic display of claim 15 wherein said pixels are one of light emitting devices or segments of a liquid crystal device.

17. The electronic display of claim 15 wherein said control system has memory and a data processor, said memory containing activation configurations for said plurality of symbols.

18. The electronic display of claim 17 wherein said plurality of symbols includes alphanumeric symbols.

* * * * *